US005661940A

United States Patent [19]

Wiens

[11] Patent Number: 5,661,940

[45] Date of Patent: Sep. 2, 1997

[54] HEAT SHIELD SHINGLE

[76] Inventor: Clifford Wiens, 240 E. Orange Dr., Phoenix, Ariz. 85012

[21] Appl. No.: 632,671

[22] Filed: Apr. 15, 1996

[51] Int. Cl.[6] ..... E04D 1/28; E04D 1/00

[52] U.S. Cl. ..... 52/519; 52/518; 52/525; 52/526; 52/539

[58] Field of Search ..... 52/521, 526, 527, 52/539, 518, 519, 523, 525, 554; D25/138, 139, 140, 141

[56] References Cited

U.S. PATENT DOCUMENTS

| | | | |
|---|---|---|---|
| 2,087,910 | 7/1937 | Honigbaum | 52/525 |
| 2,273,879 | 2/1942 | Maxey | 52/525 |
| 4,251,967 | 2/1981 | Hoofe, III | 52/527 X |
| 4,343,126 | 8/1982 | Hoofe, III . | |
| 4,498,267 | 2/1985 | Beck | D25/140 X |
| 5,305,569 | 4/1994 | Malmquist et al. . | |
| 5,333,431 | 8/1994 | Houpt . | |
| 5,392,584 | 2/1995 | Perez-Wilson | D25/139 X |
| 5,426,902 | 6/1995 | Stahl et al. . | |
| 5,440,855 | 8/1995 | Loucks | 52/518 |

*Primary Examiner*—Wynn E. Wood
*Assistant Examiner*—Timothy B. Kang

[57] ABSTRACT

The present invention provides a shingle for covering a roof or other surface. The shingle has an integral heat shield for shielding the roof from direct solar radiation. The shingle is substantially L-shaped when viewed from above and comprises two main parts, a shingle portion that is fastened to the outer surface of the roof in the usual overlapping courses, and a heat shield portion projecting upwards from the plane of the shingle portion. The heat shield portion extends over a part of an adjacent shingle, shading the shingle. The heat shield portion also provides an air passage with open top and bottom ends allowing air flow under the heat shield thereby preventing a heat build-up beneath the heat shield.

18 Claims, 2 Drawing Sheets

HEAT SHIELD SHINGLE

FIELD OF THE INVENTION

The present invention relates to roof coverings for covering a roof or similar surface.

BACKGROUND

In many areas, particularly those In hot climates, heat transferred to the roof of a building by the sun can cause a significant rise in the internal temperature of the building. This can be a problem in those areas where it is warm year round or where temperatures rise to extreme levels, since it can lead to increased energy costs for air conditioning and increased insulation costs.

The present invention is concerned with a roof covering that mitigates this problem.

SUMMARY

According to one aspect of the present invention there is provided a roofing shingle comprising:

a substantially flat shingle portion with laterally spaced apart sides; and a heat shield portion projecting upwardly from the shingle portion and extending laterally with respect to the shingle portion.

In use, the shingle portions are attached to a roof in the same way as conventional roofing shingles. This forms a waterproof covering on the roof. The heat shield portions overlie the roof, to shade respective portions of the roof. The preferred arrangement provides open air passages between the heat shield portions and the shingle portions.

The heat shield portion of each shingle may extend upwards and laterally outwards from the shingle portion, over a section of an adjacent shingle thereby shading said section. Preferably the heat shield portion is configured such that the associated air passage has open top and bottom ends. The heat shield portion may be arch shaped, to resemble the configuration of a roofing tile.

The shingles also preferably include interlocking means for interlocking shingles which are arranged adjacent one another. The Interlocking means comprise a slot in a first side of the heat shield member, and a tongue projecting outwards from a second side of the heat shield member arranged such that the tongue of each heat shield member may engage within the slot in the heat shield member of an adjacent shingle.

The shingles are preferably composed of a rigid, water resistant material including UV inhibitors.

According to another aspect of the present invention there is provided a roof having an outer surface and comprising:

a waterproof covering extending over the outer surface;

a plurality of heat shield members fixed to the waterproof covering, each heat shield member projecting upwards from the waterproof covering and extending over a respective portion of the waterproof covering at a position spaced above said portion, each heat shield member providing an air flow passage between the heat shield member and the waterproof covering.

The waterproof covering preferably comprises a plurality of shingles arranged to lie in a plane substantially parallel to the outer surface of the roof. Each one of the plurality of shingles includes a shingle portion, and one of the plurality of heat shield members as a heat shield portion. The shingles are arranged side by side in offset courses such that each course of shingles is arranged to overlap a top portion of the shingles in a lower course.

The finished roof has an attractive, relieved appearance, similar to the appearance of a tiled roof where the heat shields are arched upwardly.

BRIEF DESCRIPTION OF THE DRAWINGS

In the accompanying drawings, which illustrate an exemplary embodiment of the present invention.

DETAILED DESCRIPTION

Figure 3:
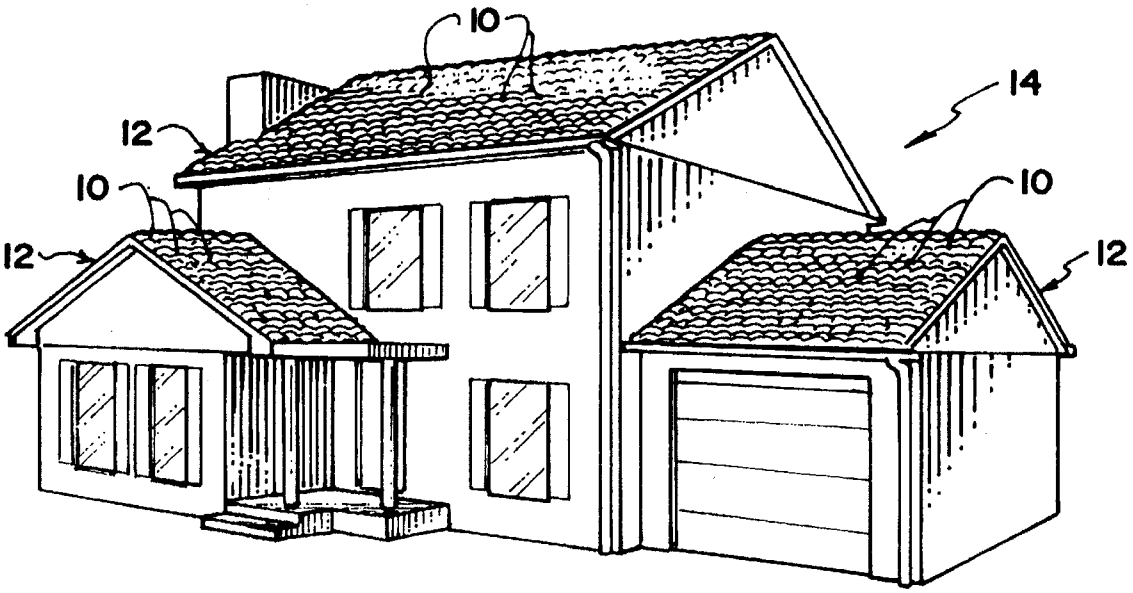
FIG. 3 is an isometric view of the shingles in place on a roof.
Figure 4:
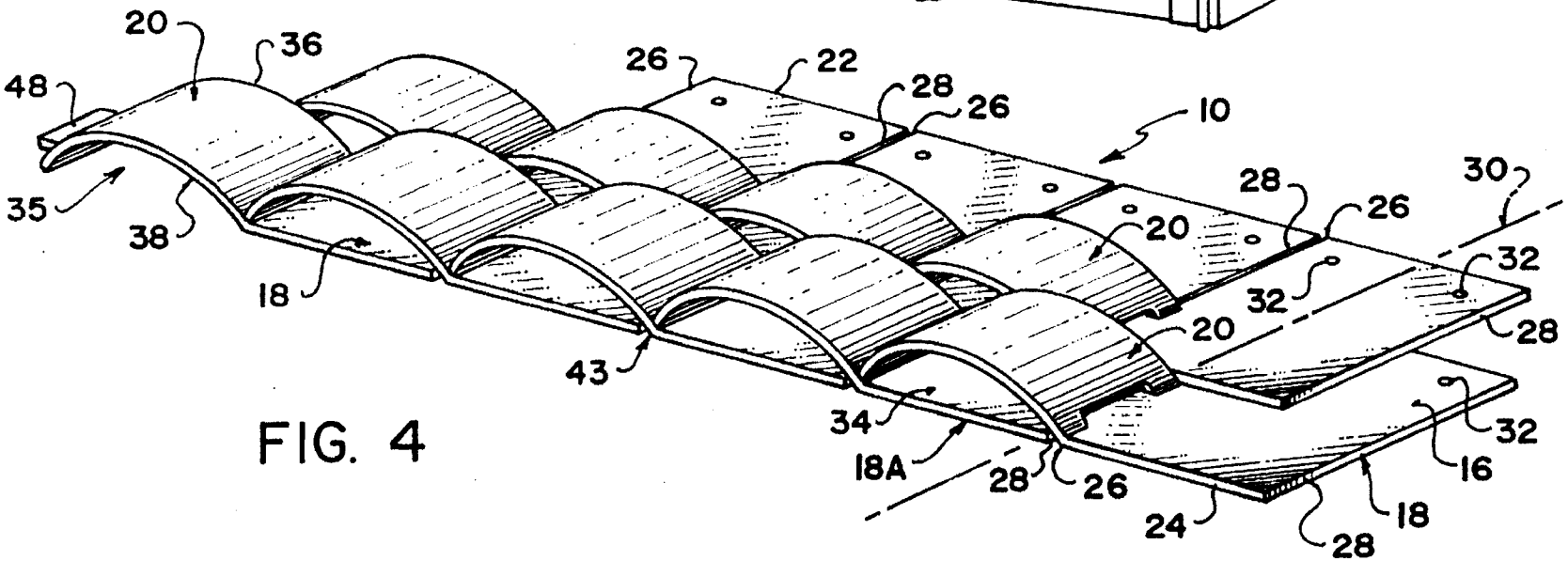
FIG. 4 isometric view of a pair of courses of heat shield shingles.

Referring to FIG. 3, the heat shield shingles are shown covering the roof 12 of a building 14 to provide a waterproof covering and to reduce the amount of heat from the sun that is transferred to the interior of the building via the roof 12. The shingles 10 are arranged side by side in offset courses, in the usual manner, such that each course of shingles 10 is arranged to overlap a top portion of the shingles 10 in a lower course.

Figure 1:
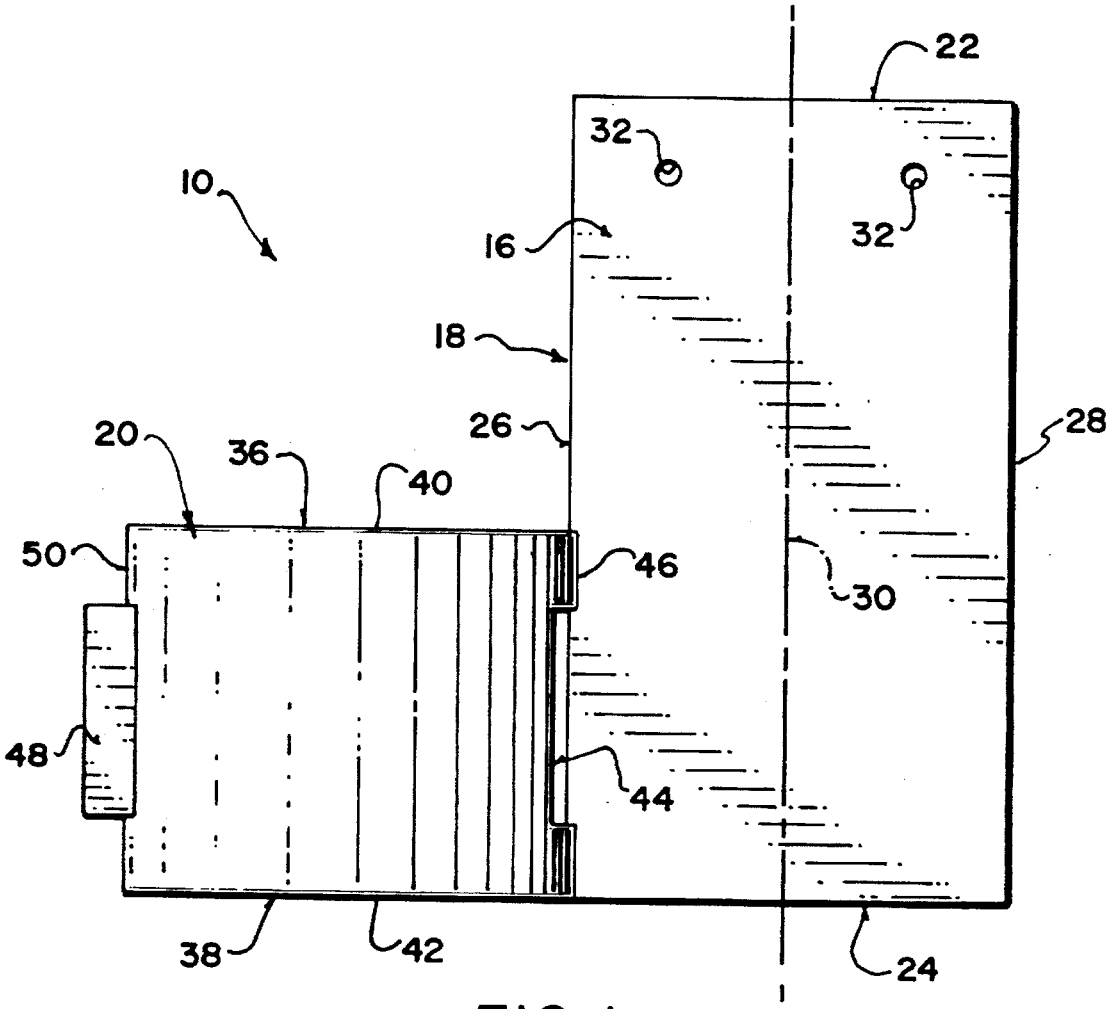
FIG. 1 top view of a heat shield shingle.
Figure 2:
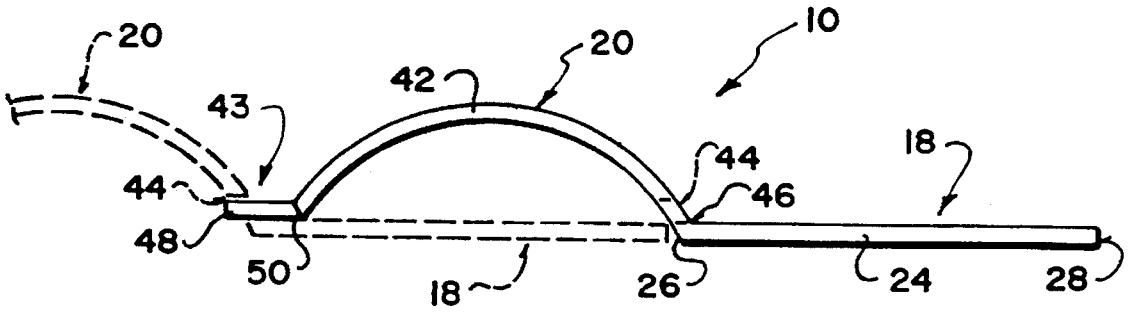
FIG. 2 is a front view of the heat shield shingle.

As illustrated most particularly in FIGS. 1 and 2, each heat shield shingle 10 is substantially L-shaped when viewed from above and comprises two main parts, a shingle portion 18, and a heat shield portion 20. The shingle portion 18 is substantially rectangular in shape and has a top end 22, a bottom end 24, a first side 26, and a second side 28. When a number of the shingles 10 are arranged in courses, adjacent shingles 10 in the same course are arranged side by side with the first side 26 of one shingle lying adjacent to the second side 28 of the other shingle. Each shingle in each course Is also arranged to lie such that a line 30 extending longitudinally through the center of the shingle portion 18 aligns with abutting first and second sides 26 and 28 of adjacent shingles 10 in the lower course.

The shingle portion 18 includes at least one nail hole 32 for receiving a nail therethrough to fix the shingle 10 to the roof 12. There are usually two holes 32 arranged in an upper portion 16 of the shingle portion 18 near the top end 22 of the shingle 10. The nail holes 32 are arranged so that the shingles 10 in a course arranged above cover over the nail holes 32 of the shingles 10 in a course below.

The heat shield portion 20 of the shingle 10 is arch shaped and is fixed to the shingle portion 18 along the first side 26. The heat shield portion 20 projects upwards from the plane of the shingle portion 18 and extends laterally outwards from the shingle portion 18.

The heat shield portion 20 extends over a lower portion 34 of an adjacent shingle portion **18*a* shading the lower portion 34 of the shingle portion 18*a* lying beneath. By shading the shingle portion 18*a* the heat shield portion 20 prevents thermal radiation from the sun from heating the shingle portion 18*a* and causes it to heat the heat shield portion 20 instead. The arched shape of the heat shield portion 20 results in a space existing between most of the heat shield portion 20 and the shingle portion 18*a*. This helps reduce the amount of heat which can be conducted from the heat shield portion 20 to the shingle portion 18*a***.

To provide good heat dissipating characteristics the air passage 35 under the heat shield portion 20 has open ends 36 and 38 at the top and bottom ends 40 and 42 respectively of the heat shield portion such that air may flow through the passage 35 thereby cooling the heat shield portion 20 and the shingle portion 18. With the open ends 36 and 38 at the top and bottom of the heat shield portion 20, both air and water may flow through freely.

Each shingle 10 includes interlocking means for interlocking adjacent shingles 10 to secure them relative to one another when they are arranged in courses on the roof 12. The interlocking means 43 include a slot 44 in a first side 46 of the heat shield portion 20, and a tongue 48 projecting outwards from a second side 50 of the heat shield portion 20. The tongue 48 and slot 44 are arranged such that the tongue 48 of each heat shield portion 20 may engage within the slot 44 in the heat shield portion 20 of an adjacent shingle 10. In the embodiment illustrated the tongue 48 projects outwards from the outer most side of the heat shield portion 20 and the slot 44 is arranged at the side edge 48 adjacent the shingle portion 18.

The shingle 10 is preferably composed of a rigid, water resistant material. This material should may also include UV inhibitors to improve the resistance of the shingle to ultraviolet radiation from the sun to increase the life of the shingle 10.

The rigid material will allow the use of the shingles as supports for temporary steps or other devices allowing persons to travel across or work on the roof.

Although the heat shield portion 20 is preferably arch shaped it may be any appropriate shape which allows it to extend over an adjacent shingle portion 18 such that most of the heat shield portion remains spaced above the adjacent shingle portion 18.

Although in the embodiment illustrated the heat shield portion 20 is shown extending from the first side 26 of the shingle portion 18 it may alternatively extend from the second side 28.

In another alternative arrangement the positioning of the tongue 48 and slot 44 may be reversed.

While one embodiment of the present invention has been described in the foregoing, it is to be understood that other embodiments are possible within the scope of the invention. The invention is to be considered limited solely by the scope of the appended claims.

I claim:

1. A roofing shingle Composed of a rigid water resistant material and comprising:

a substantially flat shingle portion with laterally spaced apart sides; and a heat shield portion fixed to the shingle portion projecting upwardly from the shingle portion and extending laterally from one of the sides of the shingle portion to provide a substantially L-shape.

2. A shingle in accordance with claim 1 wherein the heat shield portion is fixed to the shingle portion along one side thereof.

3. A shingle in accordance with claim 1 wherein the heat shield portion is configured to provide an air passage under the heat shield portion, the air passage having opposed open ends.

4. A shingle in accordance with claim 1 wherein the opposed open ends of the air passage lie at top and bottom ends of the heat shield portion.

5. A shingle in accordance with claim 1 including interlocking means comprising a slot in a first side of the heat shield portion, and a tongue projecting outwards from a second side of the heat shield portion arranged such that the tongue of each heat shield portion may engage within the slot in the heat shield portion of an adjacent shingle.

6. A shingle in accordance with claim 1 wherein the shingle portion includes at least one nail hole therethrough, and wherein the at least one nail hole is arranged adjacent a top edge of the shingle portion.

7. A roof having an outer surface and a shingle layer secured to the outer surface, the shingle layer comprising:

plurality of shingles fastened to the outer surface of the roof, the shingles having:

respective shingle portions arranged side by side in offset courses, with the shingles of each course overlapping the shingles in a lower course to provide a waterproof covering extending over the outer surface; and heat shield members fixed to respective ones of the shingle portions, each heat shield member having spaced apart first and second sides and projecting upwards from the waterproof covering between the first and second sides and extending over a respective portion of the waterproof covering at a position spaced above said portion, each heat shield member providing an air flow passage between the heat shield member and the waterproof covering; and interlocking means comprising a slot in the first side of each heat shield member, and a tongue projecting from the second side of each heat shield member with the tongue of each heat shield member engaged in the slot in the heat shield member of an adjacent shingle.

8. A roof in accordance with claim 7 wherein the heat shield member of each shingle extends upwards and laterally outwards from the shingle member over a section of an adjacent shingle thereby shading said section of the adjacent shingle member.

9. A roof in accordance with claim 7 wherein each air flow passage has opposed open ends at top and bottom ends of the respective heat shield portion.

10. A roof in accordance with claim 7 wherein each of the plurality of heat shield members is arch shaped.

11. A roof in accordance with claim 7 wherein each one of the plurality of shingles is substantially L-shaped.

12. A roof in accordance with claim 7 wherein each one of the plurality of shingles is composed of a rigid water resistant material.

13. A roofing shingle comprising:

a substantially flat shingle portion with laterally spaced apart sides;

a heat shield portion having a first side and a second side, said heat shield portion projecting upwardly from the shingle portion and extending laterally with respect to the shingle portion;

and interlocking means comprising a slot in the first side of the heat shield portion, and a tongue projecting outwards from the second side of the heat shield portion arranged such that the tongue of each heat shield portion may engage within the slot in the heat shield portion of an adjacent shingle.

14. A shingle in accordance with claim 13 wherein the shingle is substantially L-shaped, with the heat shield portion fixed to the shingle portion along one side thereof.

15. A shingle in accordance with claim 14 wherein the heat shield portion is fixed to the shingle portion along one side thereof.

16. A shingle in accordance with claim 13 wherein the heat shield portion is configured to provide an air passage under the heat shield portion, the air passage having opposed open ends.

17. A shingle in accordance with claim 15 wherein the opposed open ends of the air passage lie at top and bottom ends of the heat shield portion.

18. A shingle in accordance with claim 13 wherein the shingle portion includes at least one nail hole therethrough, and wherein the at least one nail hole is arranged adjacent a top edge of the shingle portion.

* * * * *